US009930940B2

(12) United States Patent
Ogura

(10) Patent No.: US 9,930,940 B2
(45) Date of Patent: Apr. 3, 2018

(54) SEPARABLE SLIDE FASTENER

(71) Applicant: YKK CORPORATION OF AMERICA, Marietta, GA (US)

(72) Inventor: Suguru Ogura, Macon, GA (US)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 15/094,159

(22) Filed: Apr. 8, 2016

(65) Prior Publication Data

US 2017/0290395 A1 Oct. 12, 2017

(51) Int. Cl.

| | |
|---|---|
| ***A44B 19/38*** | (2006.01) |
| ***A44B 19/02*** | (2006.01) |
| ***A44B 19/36*** | (2006.01) |

(52) U.S. Cl.

CPC ..... *A44B 19/38* (2013.01); *A44B 19/02* (2013.01); *A44B 19/36* (2013.01); *Y10T 24/2588* (2015.01)

(58) Field of Classification Search

CPC ..... A44B 19/02; A44B 19/36; A44B 19/38; A44B 19/28; Y10T 24/2588

See application file for complete search history.

(56) References Cited

U.S. PATENT DOCUMENTS

| | | | | |
|---|---|---|---|---|
| 2,224,930 | A * | 12/1940 | Roseman | A44B 19/24 223/111 |
| 4,078,279 | A * | 3/1978 | Heimberger | A44B 19/38 24/434 |
| 7,073,233 | B2 * | 7/2006 | Leva | A44B 19/26 24/386 |
| 2013/0061436 | A1 | 3/2013 | Peters et al. | |

FOREIGN PATENT DOCUMENTS

| | | | |
|---|---|---|---|
| CN | 102106630 | B | 4/2013 |
| JP | 4103088 | B2 | 4/2008 |
| JP | 4628329 | B | 11/2010 |
| JP | 2014-526316 | A | 10/2014 |
| WO | 2014/063031 | A1 | 4/2014 |

* cited by examiner

*Primary Examiner* — Robert Sandy
(74) *Attorney, Agent, or Firm* — Kilpatrick Townsend & Stockton LLP

(57) ABSTRACT

A slide fastener includes a first tape with a plurality of first elements, a second tape with a plurality of second elements, and a slider element configured to interface with the first tape and the second tape. The slider element includes a body portion and a removable portion that are configured to selectively mechanically engage/disengage with one another.

14 Claims, 11 Drawing Sheets

SEPARABLE SLIDE FASTENER

FIELD OF THE INVENTION

This invention relates to a separable slide fastener with a slider element that includes a plurality of components that can be separated from one another.

BACKGROUND

Slide fastener devices are used to secure two pieces of fabric, tape, or other flexible material, such as on a garment, bag, or other article. A slide fastener includes a plurality of elements located on tapes to open and close the slide fastener such that a slider engages with the elements. When the slider is moved along the tape, the rows of opposing elements of the tape mesh together to close the slide fastener. When the slider is moved in the opposite direction, the slider separates the rows of opposing elements to open the slide fastener. Some slide fasteners include magnets for attaching components to one another. However, magnets may adversely affect medical devices and/or electronic devices. In some applications, a user may wish to open the slide fastener quickly and/or without moving the slider to the bottom of the rows of elements. For example, a user may want to operate a slide fastener using one hand.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Versions of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain cases, a slide fastener includes: a first tape including a plurality of first elements; a second tape including a plurality of second elements; and a slider element movable along the first tape and the second tape, the slider element including a body portion and a removable portion, wherein the body portion and the removable portion are configured to move between: an engaged position where the body portion and the removable portion are mechanically coupled together; and a disengaged position where the body portion and the removable portion are separate from one another.

According to certain cases, a slider element for a slide fastener includes: a female body portion including a cavity; and a male removable portion including an actuation portion, an upper engaging member adjacent an upper side of the actuation portion, and a lower engaging member adjacent a lower side of the actuation portion, wherein the male removable portion is configured to be inserted into the cavity of the female body portion to couple the female body portion with the male removable portion.

According to certain cases, a method for engaging a slide fastener includes: arranging a body portion adjacent to a first end of a first tape such that the first tape passes through a passage of the body portion; arranging a removable portion adjacent to a first end of a second tape such that the second tape passes through a passage of the removable portion; aligning the removable portion with respect to the body portion such that an actuation portion of the removable portion is disposed adjacent to a recess of the body portion; and pushing the removable portion toward the recess such that the removable portion and the body portion are mechanically attached to one another.

According to certain cases, a method for disengaging a slide fastener includes: depressing an actuation portion of a removable portion; moving an upper engaging member of the removable portion beyond an upper ear of a body portion to separate the upper engaging member from the upper ear; moving a lower engaging member of the removable portion beyond a lower ear of the body portion to separate the lower engaging member from the lower ear; and pulling the removable portion out of a cavity of the body portion.

BRIEF DESCRIPTION OF THE DRAWINGS

Illustrative embodiments of the present disclosure are described in detail below with reference to the following drawing figures.

DETAILED DESCRIPTION

The subject matter of versions of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1A-9C depict non-limiting examples of slide fasteners. Even if different reference numbers are used in various drawings, any of the features shown or described in relation to any of the drawings may be included, combined, substituted, or omitted to provide additional examples.

Figure 1A:
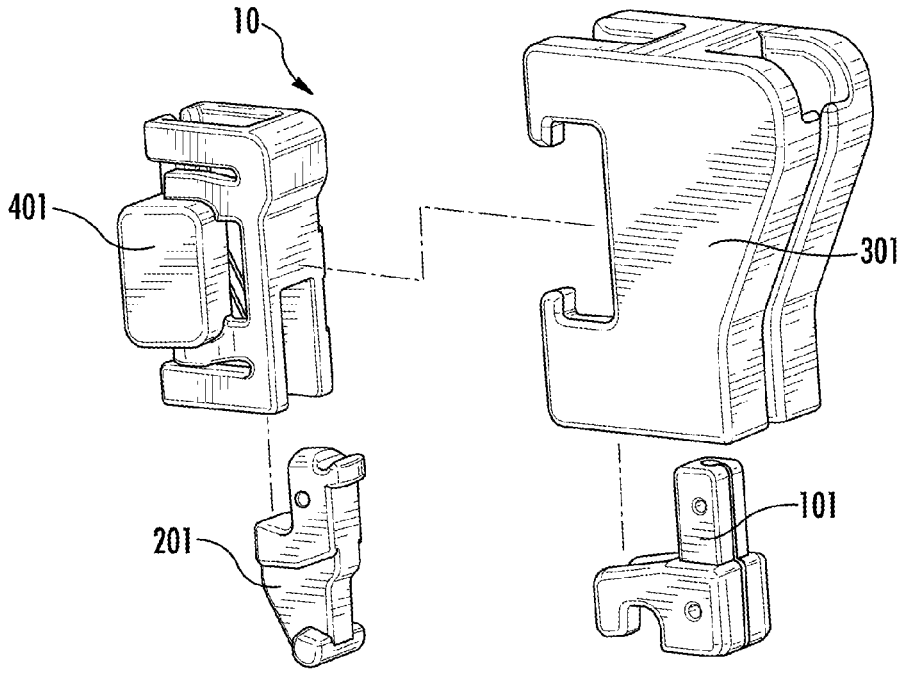
FIG. 1A is an exploded perspective view of a slide fastener according to certain aspects.
Figure 1B:
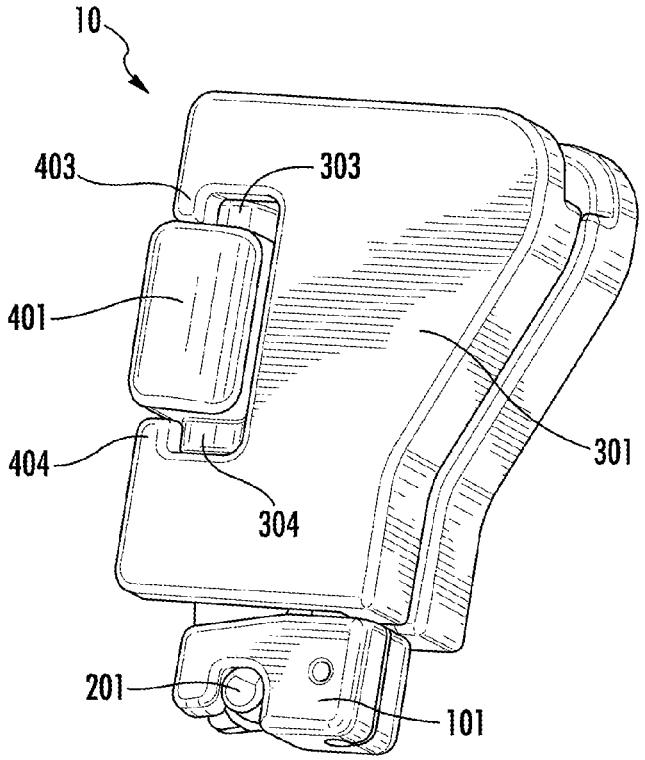
FIG. 1B is an assembled perspective view of the slide fastener of FIG. 1A.

FIGS. 1A and 1B illustrate a non-limiting example of a slider element 10 that includes a body portion 301 and a removable portion 401. As shown in FIGS. 8A, 8B, 9B, and 9C, the body portion 301 interfaces with a first tape 1 such that tape 1 passes through passage 321 (see FIG. 3A) and the removable portion 401 interfaces with a second tape 2 such that tape 2 passes through passage 422 (see FIG. 4A). The first tape 1 also interfaces with a box unit 101 at a first end at the bottom of the first tape 1. Similarly, the second tape 2 also interfaces with a pin unit 201 at a first end at the bottom of the second tape 2.

Figure 2:
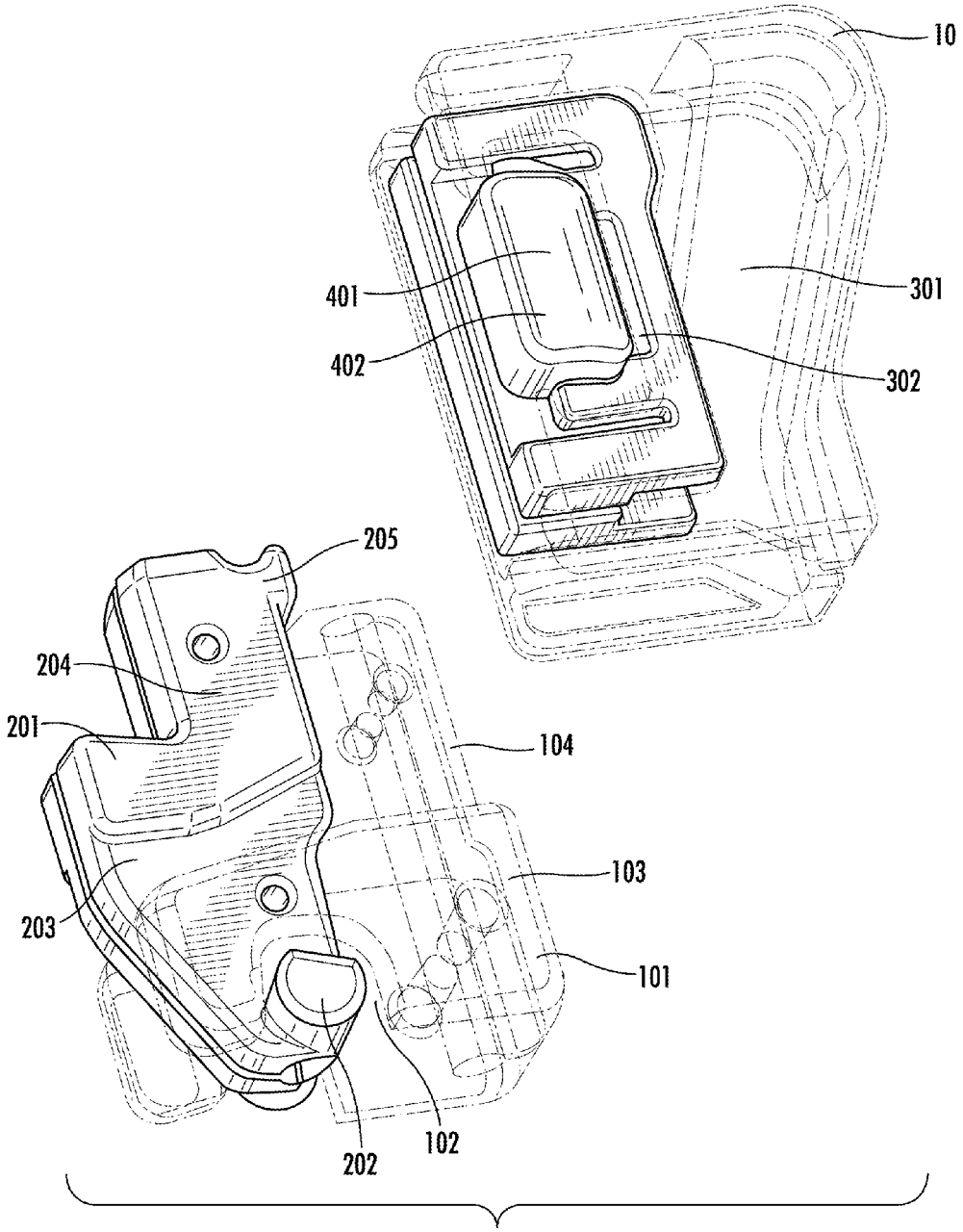
FIG. 2 is a perspective view of the slide fastener of FIG. 1A.

As shown in FIG. 2, the body portion 301 (which is shown as transparent in FIG. 2) and the removable portion 401 are configured to mechanically couple together. The body portion 301 and the removable portion 401 are shown in an engaged position in FIGS. 1B, 2A, 7, 8D, 8E, and 9A. When the removable portion 401 and the body portion 301 are engaged with one another, a protrusion 410 of the removable portion 401 interfaces with a corresponding cutout 310 of the body portion 301. As illustrated in FIG. 2, the body portion 301 includes a recess 302 (see FIGS. 3A and 3B) that receives an actuation portion 402 of the removable portion 401 (see FIGS. 4A and 4B). In some examples, a majority of the removable portion 401 is received within cavity 322 of the body portion 301 when the two components are assembled or engaged with one another (see FIG. 2) such that the actuation portion 402 of the removable portion 401 is exposed through the recess 302.

Although the figures show the body portion 301 as a larger component (compared to the removable portion 401) that includes a recess 302 (see FIGS. 3A and 3B) that corresponds to an actuation portion 402 of the removable portion 401 (see FIGS. 4A and 4B) where the body portion 301 is female and the removable portion 401 is male (i.e., the removable portion 401 is inserted into the body portion 301), these components may be configured differently. For example, the body portion 301 and the removable portion 401 may be approximately equal in size and/or the removable portion 401 may be larger than the body portion 301. In some instances, the removable portion 401 (interfacing with the second tape 2) may be a female component while the body portion 301 (interfacing with the first tape 1) may be a male component.

Figure 3A:
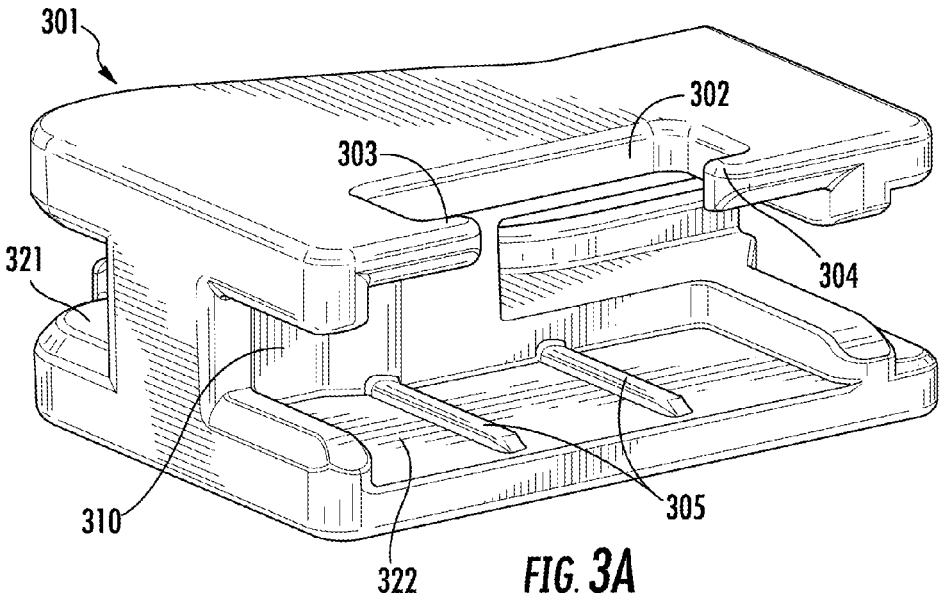
FIG. 3A is a perspective view of a body portion of the slider element of FIG. 1A.
Figure 3B:
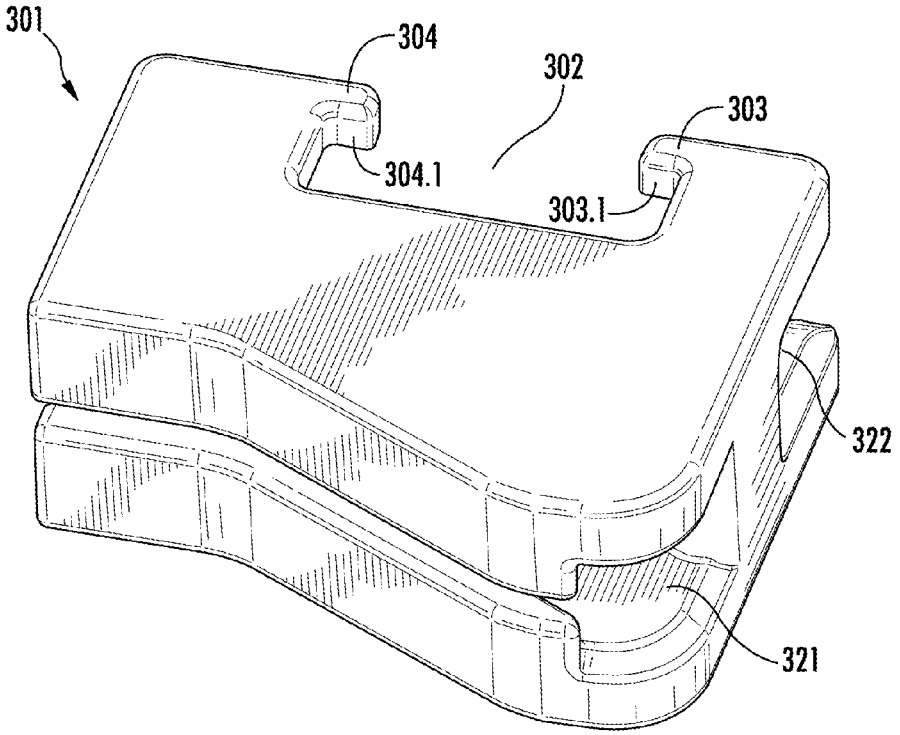
FIG. 3B is another perspective view of the body portion of the slider element of FIG. 3A.
Figure 4A:
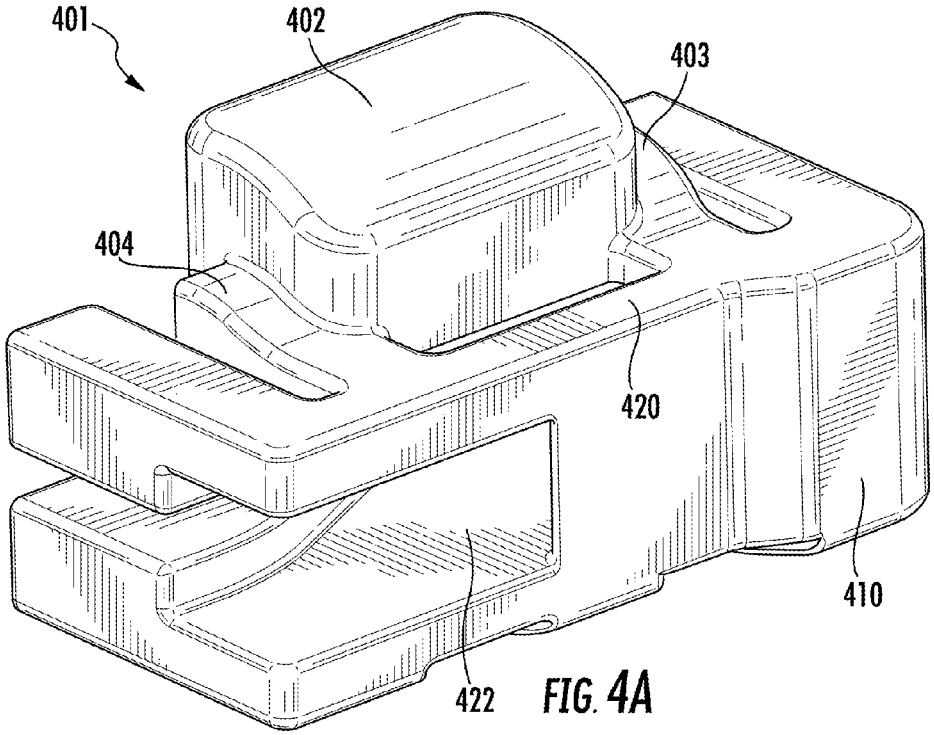
FIG. 4A is a perspective view of a removable portion of the slider element of FIG. 1A.
Figure 4B:
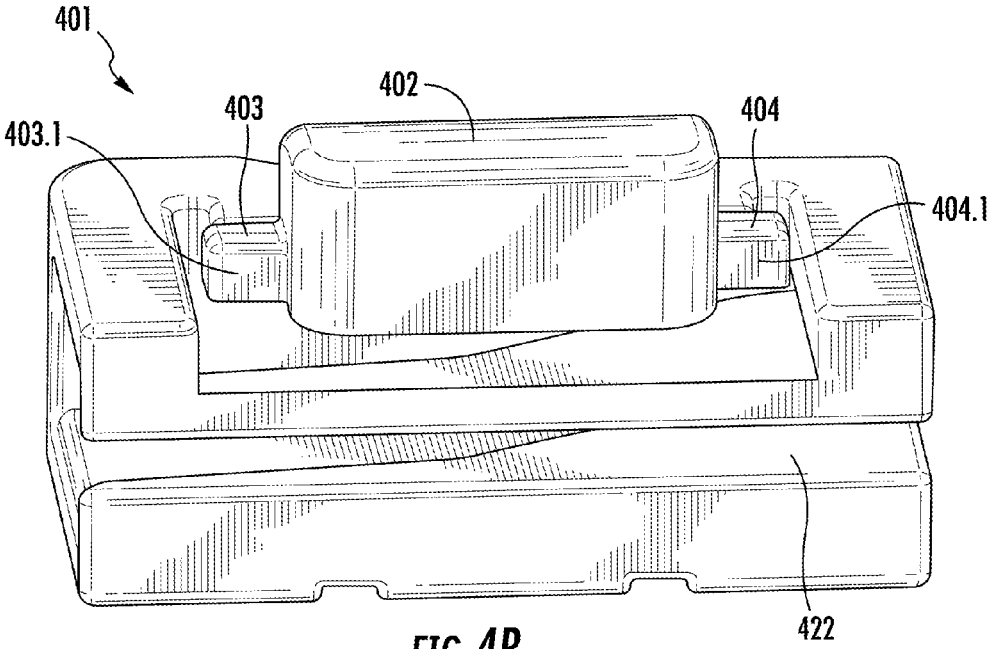
FIG. 4B is another perspective view of the removable portion of the slider element of FIG. 4A.
Figure 4C:
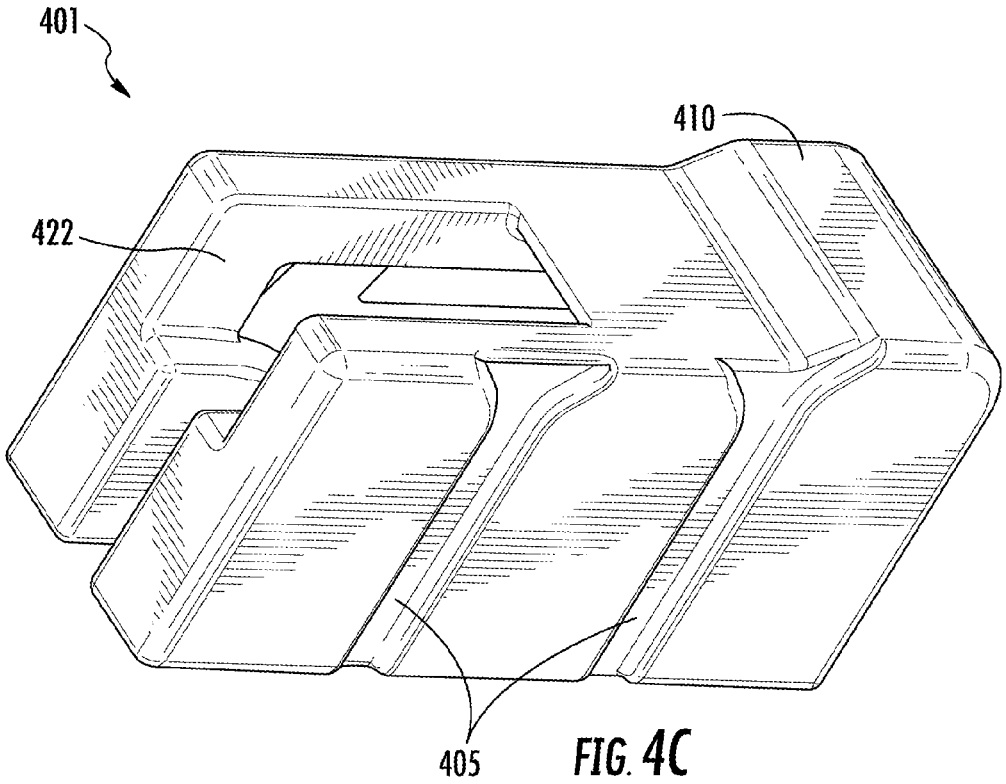
FIG. 4C is a bottom perspective view of the removable portion of the slider element of FIG. 4A.

As shown in FIGS. 3A and 3B, the body portion 301 includes two static ears, upper ear 303 and lower ear 304, that are adjacent to recess 302. The upper and lower ears 303 and 304 engage with upper and lower engaging members 403 and 404 of the removable portion 401 (see FIGS. 4A and 4B), respectively. In some examples, movement of the upper and lower engaging members 403 and 404 is influenced by the actuation portion 402. In some cases, the actuation portion 402 is a button that, when depressed, disengages the removable portion 401 from the body portion 301. When pressed, the actuation portion 402 pivots about an inner portion 420. However, the actuation portion 402 may be another type of device such as sliding latch, toggle switch, a pushbutton spring switch that moves strictly in an up/down direction, or any other appropriate device. In some examples, in the engaged condition, (i) an inner face 303.1 of the upper ear 303 contacts an end surface 403.1 of the upper engaging member 403 and (ii) an inner face 304.1 of the lower ear 304 contacts an end surface 404.1 of the lower engaging member 404. As such, the removable portion 401 can be securely constrained and/or attached to the body portion 301.

To disengage the removable portion 401 from the body portion 301, the actuation portion 402 is depressed to move the upper and lower engaging members 403 and 404 of the removable portion 401 downward into a cavity 322 of the body portion 301 toward rails 305 (see FIG. 3A). Once the upper engaging member 403 is below the upper ear 303 and the lower engaging member 404 is below the lower ear 304, the removable portion 401 is free to move relative to the body portion 301 and thus disengage from the body portion 301. In some cases, the removable portion 401 includes one or more channels 405 (see FIG. 4C) that correspond to and receive the one or more rails 305 of the body portion 301 to guide the movement of the removable portion 401 relative to the body portion 301 during engagement and/or disengagement of the removable portion 401 to and/or from the body portion 301.

Figure 5:
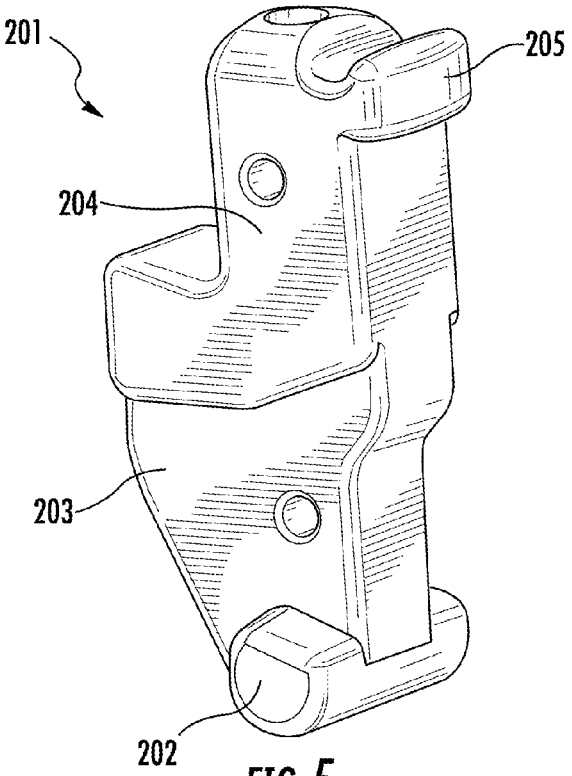
FIG. 5 is a perspective view of a pin unit of the slider element of FIG. 1A.
Figure 6:
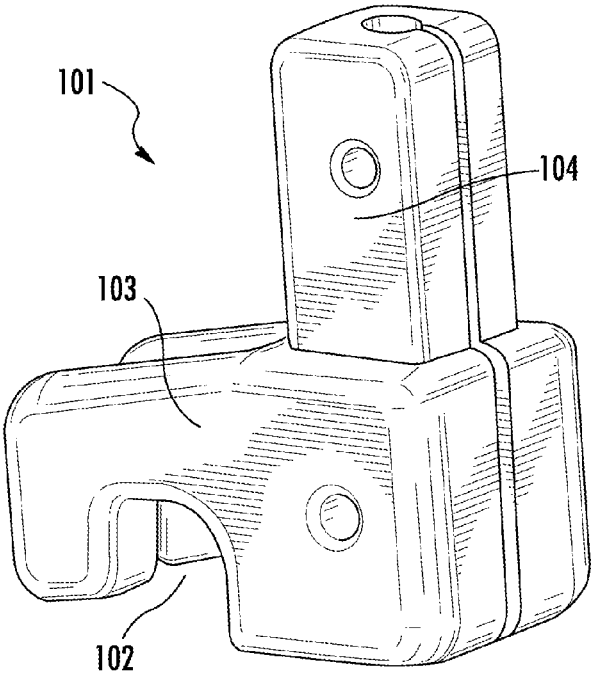
FIG. 6 is a perspective view of a box unit of the slider element of FIG. 1A.
Figure 7:
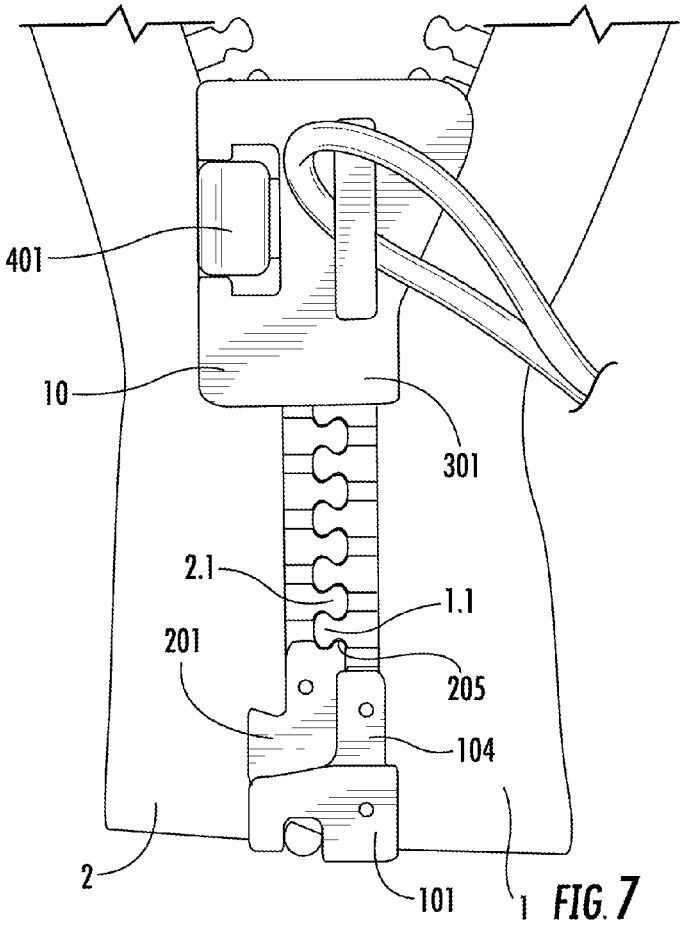
FIG. 7 is a front view of the slider fastener of FIG. 1A, shown positioned on two tapes.

FIGS. 5 and 6 show the box unit 101 and the corresponding pin unit 201. As described above, in some cases, the box unit 101 is fixedly attached to a lower portion of the of the first tape 1 and the pin unit 201 is fixedly attached to a lower portion of the second tape 2. As shown in FIG. 6, the box unit 101 includes a pair of hook portions 103 that each include an opening 102 and an upper portion 104. As shown in FIG. 5, the pin unit 201 includes a pin 202 with ends that are configured to be received into the two openings 102 of the box unit 101. The pin 202 may be approximately cylindrical, although it need not be. The pin unit 201 also includes one or more recessed areas 203 to provide clearance for the hook portions 103 to move adjacent to the pin 202 and to position the openings 102 adjacent to the pin 202. The upper portion 104 of the box unit 101 and an upper portion 204 of the pin unit 201 are approximately the same thickness and are disposed adjacent one another when the box unit 101 and the pin unit 201 are engaged with one another (see FIGS. 2, 7, and 8E). As shown in FIGS. 7 and 8E, a protrusion 205 of the pin unit 201 is configured to be disposed between the top of the upper portion 104 and a lower-most element 1.1 of the first tape 1.

Figure 8A:
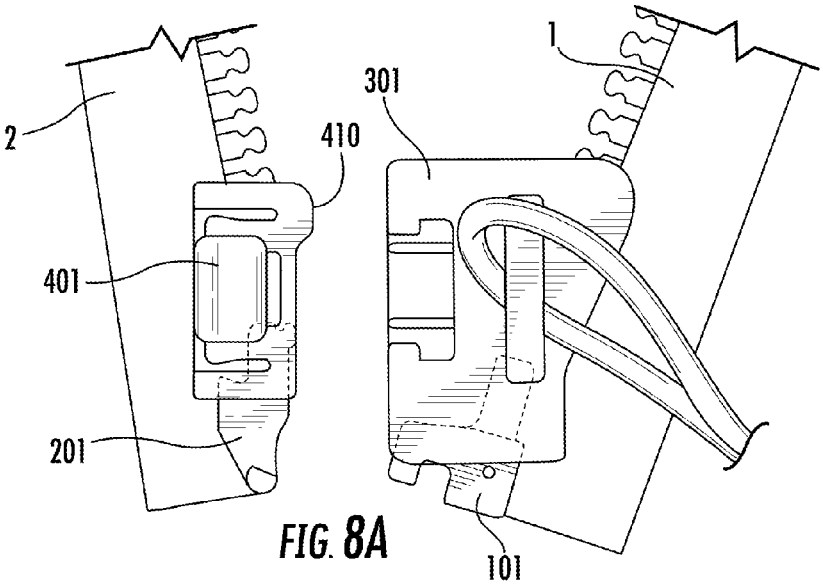
FIGS. 8A, 8B, 8C, 8D, and 8E are front views of the slide fastener of FIG. 1A in various positions along two tapes.
Figure 8B:
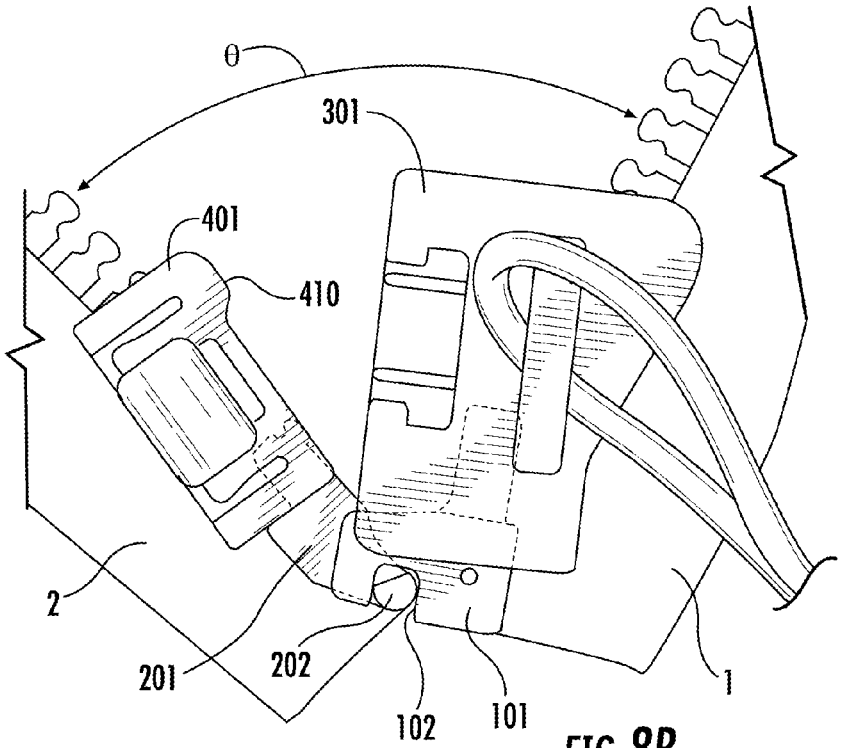
Figure 8C:
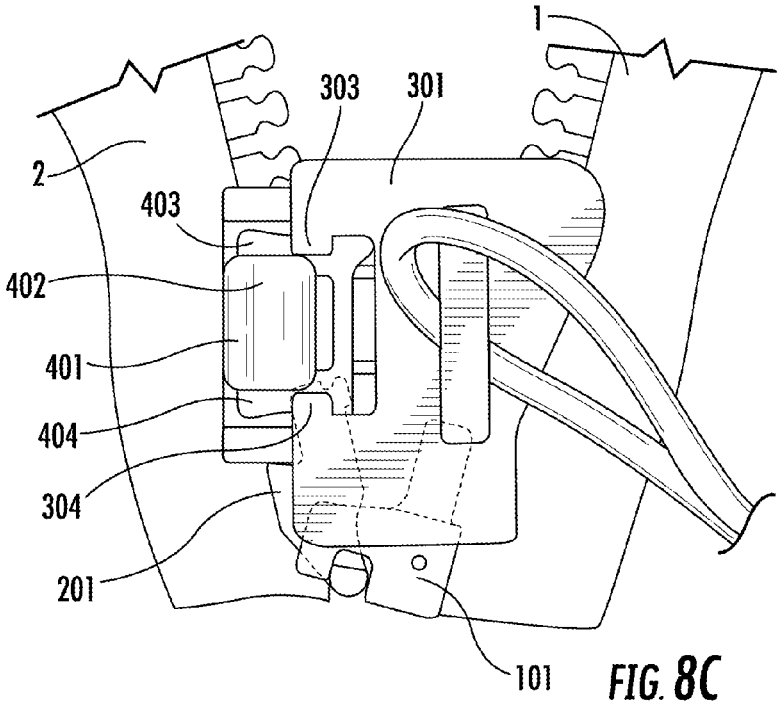
Figure 8D:
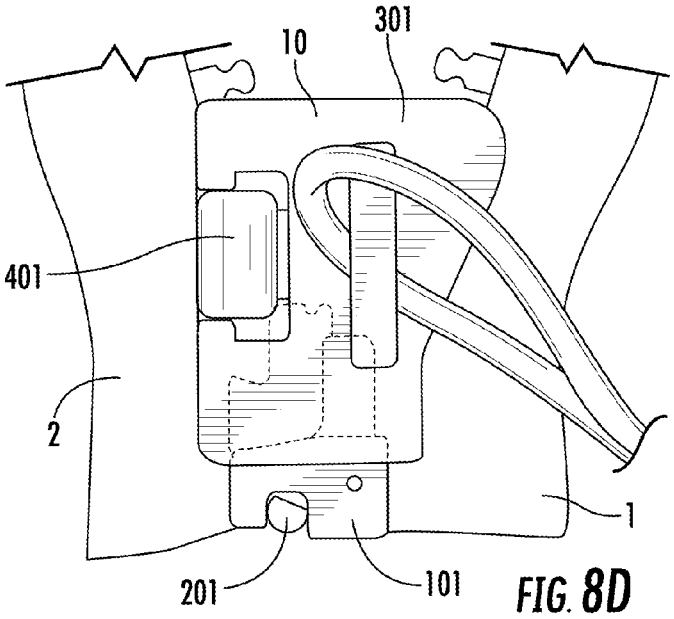
Figure 8E:
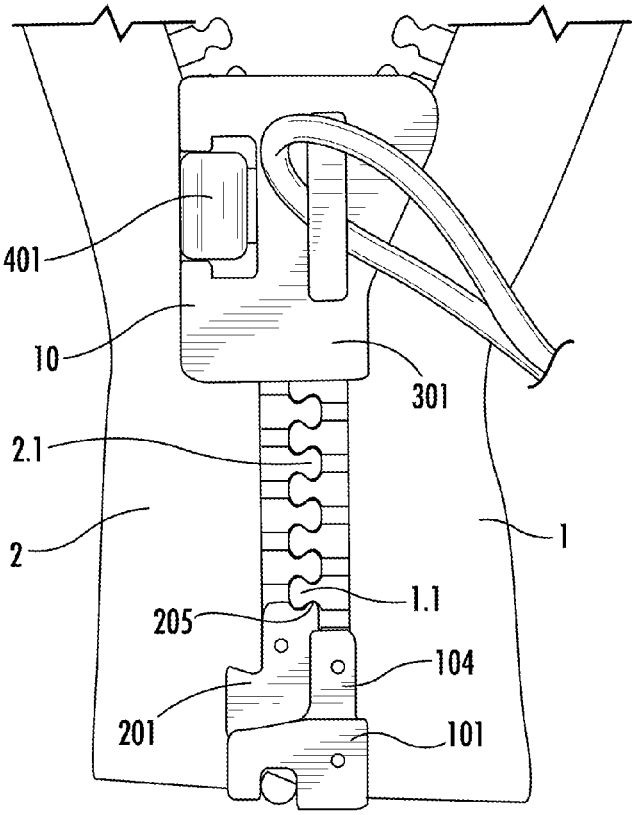

An exemplary process for engaging a slide fastener is shown in FIGS. 8A-8E. As shown in FIG. 8A, the body portion 301 is attached to the first tape 1 such that the first tape 1 passes through passage 321 and the removable portion 401 is attached to the second tape 2 such that the second tape 2 passes through passage 422. FIG. 8A shows the slide fastener in the disengaged position, with the body portion 301 separate from the removable portion 401. The body portion 301 and the removable portion 401 are each disposed near the bottom of the respective of the respective tapes 1 and 2. As shown in FIG. 8B, the ends of pin 202 are inserted into the openings 102. Based on the shape of the hook portions 103, the recessed areas 203, the openings 102, and the pin 202, the first and second tapes 1 and 2 are disposed at an angle θ with respect to one another. The angle θ is approximately 10°-145°. In some examples, the angle θ is approximately 15°-120°. In some cases, the angle θ is approximately 20°-90°.

After the ends of pin 202 are inserted into the openings 102, the removable portion 401 is aligned with respect to the body portion 301 as shown in FIG. 8C such that the actuation portion 402 is disposed adjacent to the recess 302 and such that the actuation portion 402 can slide between the upper and lower ears 303 and 304. In addition, the rails 305 are aligned with the channels 405. Next, the removable portion 401 is pushed toward the recess 302 such that (i) upper ear 303 presses against the curved or slanted upper surface of the engaging member 403 to press the engaging member 403 downward toward rails 305; (ii) lower ear 304 presses against the curved or slanted upper surface of the engaging member 404 to press the engaging member 404 downward toward rails 305; and (iii) rails 305 slide through channels 405. The downward movement of upper and lower engaging members 403 and 404 also causes actuation portion 402 to move downward.

When the removable portion 401 is fully inserted into the body portion 301 and the protrusion 410 is inserted into the cutout 310, the upper and lower engaging members 403 and 404 are pushed inward (toward tape 1) sufficiently past upper and lower ears 303 and 304 such that the upper and lower engaging members 403 and 404 (and actuation portion 402) snap upwards. The upward movement of the upper and lower engaging members 403 and 404 (and actuation portion 402) creates an audible and/or tactile indication that the removable portion 401 and the body portion 301 are engaged with one another. FIGS. 8D and 8E illustrate the body portion 301 and the removable portion 401 in the engaged position. In this engaged position, (i) the inner face 303.1 of the upper ear 303 contacts the end surface 403.1 of the upper engaging member 403 and (ii) the inner face 304.1 of the lower ear 304 contacts the end surface 404.1 of the lower engaging member 404. Finally, as shown in FIG. 8E, after the removable portion 401 and the body portion 301 are engaged with one another, the assembled slider element 10 can be moved up to engage elements from the two tapes together. For example, the slider element 10 engages the first elements 1.1 of the first tape 1 with the second elements 2.1 of the second tape 2.

Figure 9A:
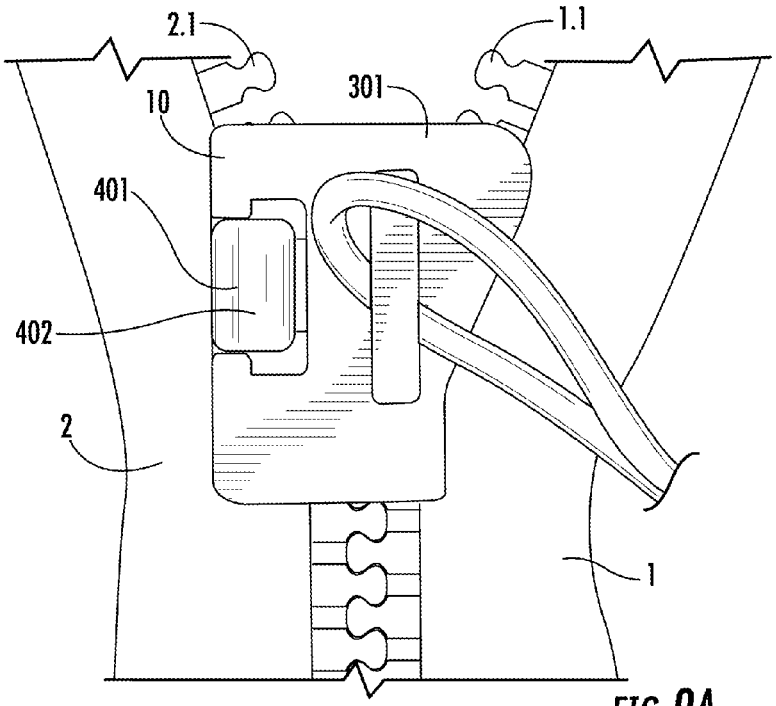
FIGS. 9A, 9B, and 9C are various front views of components of the slide fastener of FIG. 1A positioned on two tapes.
Figure 9B:
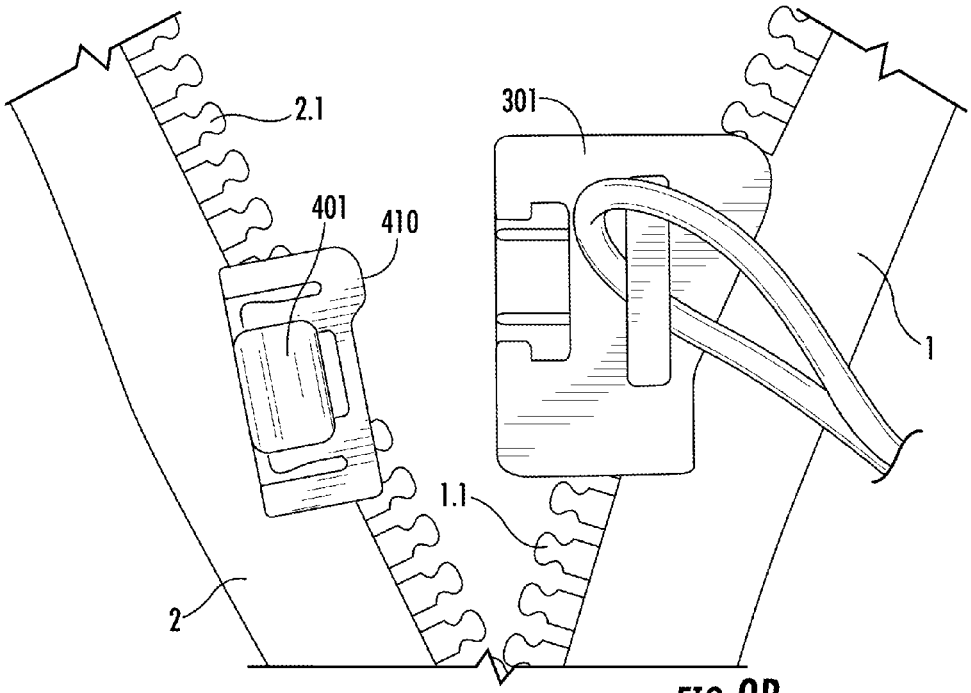
Figure 9C:
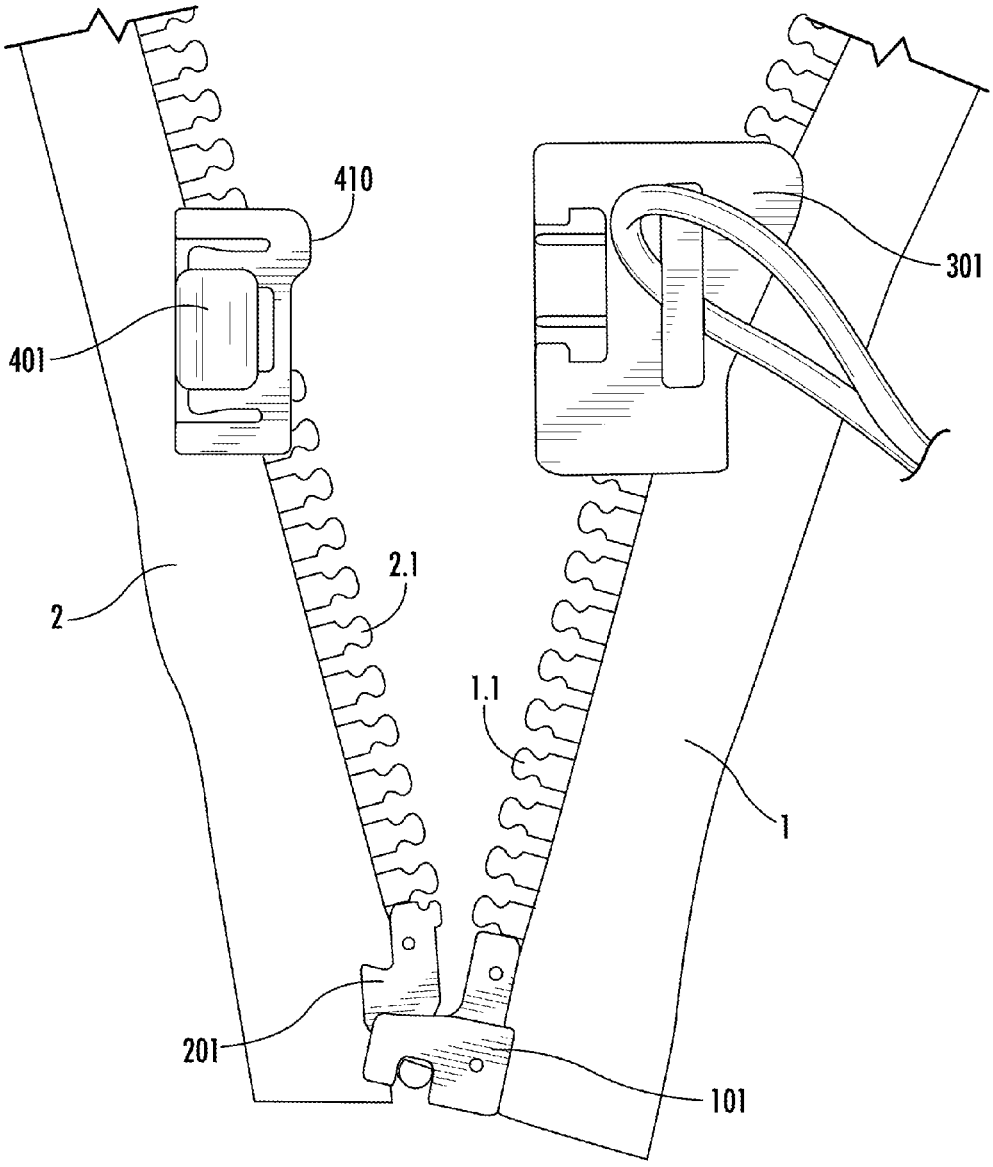

An exemplary process for disengaging a slide fastener is shown in FIGS. 9A-9C. As shown in FIG. 9A, the components of the slider element 10 are engaged with one another and can be located at any position with respect to tapes 1 and 2. To begin the disengagement process, the user depresses the actuation portion 402 such that the actuation portion 402 pivots about the inner portion 420 and the upper and lower engaging members 403 and 404 move relative to the upper and lower ears 303 and 304, respectively. While holding the actuation portion 402 in the depressed position, the user can pull the removable portion 401 out of cavity 322 of the body portion 301 and away from cutout 310 of the body portion 301. The movement of the removable portion 401 is constrained by the movement of rails 305 sliding through the channels 405.

Once the upper and lower engaging members 403 and 404 move below the upper and lower ears 303 and 304, the user can release the actuation portion 402. At this point, the user can pull the removable portion 401 completely out of cavity 322 of the body portion 301. This movement can be accomplished by (i) pulling directly on one or both of the removable portion 401 and the body portion 301 (in opposite directions) or (ii) pulling on one or both of the tapes 1 and 2 (or the object attached thereto). After the removable portion 401 is separated from the body portion 301, the user can pull the two tapes apart from one another such that the elements from the two tapes separate from one another. In other words, the slide fastener can be completely disengaged without moving the slider element 10 to the bottom of the tapes 1 and 2. In this way, the slide fastener may be engaged and disengaged more easily and efficiently. In some instances, the geometry of the body portion 301 and the removable portion 401 allow a user to operate the slide fastener with one hand.

The components of the slide fastener may be formed of materials including, but not limited to, nylon, polypropylene, non-woven polypropylene, other plastic materials, thermoplastic, metallic materials, other composite materials, cotton, wool, synthetic fabric, or other similar materials. Moreover, the components of the slide fastener may be attached to one another via suitable fasteners, which include, but are not limited to, glue or any suitable adhesive, hook and loop fasteners, ultrasonic welding, other mechanical or chemical fasteners.

Different arrangements of the components depicted in the drawings or described above, as well as components and steps not shown or described are possible. Similarly, some features and sub-combinations are useful and may be employed without reference to other features and sub-combinations. Cases of the invention have been described for illustrative and not restrictive purposes, and alternative cases will become apparent to readers of this patent. Accordingly, the present invention is not limited to the cases described above or depicted in the drawings, and various cases and modifications may be made without departing from the scope of the claims below.

That which is claimed is:

1. A slide fastener comprising:

a first tape comprising a plurality of first elements;

a second tape comprising a plurality of second elements; and a slider element movable along the first tape and the second tape to (i) engage the plurality of first elements and the plurality of second elements with each other and (ii) disengage the plurality of first elements and the plurality of second elements from each other, the slider element comprising a body portion attached to and movable along the first tape and a removable portion attached to and movable along the second tape, wherein the body portion and the removable portion are configured to move between:

an engaged position where the body portion and the removable portion are mechanically coupled together; and a disengaged position where the body portion and the removable portion are separate from one another.

2. The slide fastener of claim 1, wherein the removable portion comprises an actuation portion configured to move the removable portion and the body portion between the engaged position and the disengaged position.

3. The slide fastener of claim 2, wherein:

the removable portion comprises an upper engaging member adjacent an upper side of the actuation portion and a lower engaging member adjacent a lower side of the actuation portion; and the actuation portion is configured to pivot relative to the body portion.

4. The slide fastener of claim 3, wherein the body portion comprises a cavity, a recess, an upper ear adjacent an upper side of the recess, and a lower ear adjacent a lower side of the recess.

5. The slide fastener of claim 4, wherein, when the removable portion and the body portion are in the engaged position:

at least a portion of the removable portion is disposed within the cavity of the body portion;

a majority of the actuation portion is disposed within the recess of the body portion;

a first end surface of the upper engaging member contacts a first inner face of the upper ear of the body portion; and a second end surface of the lower engaging member contacts a second inner face of the lower ear of the body portion.

6. The slide fastener of claim 4, wherein:

the body portion comprises at least one rail disposed in the cavity;

the removable portion comprises at least one channel; and the at least one rail is slidable within the at least one channel when the removable portion is inserted into the cavity.

7. The slide fastener of claim 1, wherein:

the first tape comprises a box unit attached at a first end of the first tape; and the second tape comprises a pin unit attached at a first end of the second tape.

8. The slide fastener of claim 7, wherein:

the box unit comprises an upper portion and a pair of hook portions that each include an opening; and the pin unit comprises at least one recessed area and a pin, wherein the pin has ends that are insertable into the openings.

9. The slide fastener of claim 1, wherein coupling the removable portion with the body portion comprises movement that is approximately perpendicular to a longitudinal direction of the first tape and the second tape.

10. A slider element for joining a first tape and a second tape of a slide fastener, the slider element comprising:

a female body portion comprising a cavity; and a male removable portion comprising an actuation portion, an upper engaging member adjacent an upper side of the actuation portion, and a lower engaging member adjacent a lower side of the actuation portion, wherein:

the male removable portion is configured to be inserted into the cavity of the female body portion to couple the female body portion with the male removable portion;

the female body portion comprises a passage through which elements of the first tape can pass, wherein the female body portion is movable along the first tape;

the male removable portion comprises a passage through which elements of the second tape can pass, wherein the male removable portion is movable along the second tape; and when the male removable portion and the female body portion are coupled with one another, movement of the slider element along the first and second tapes causes (i) the elements of the first tape and the elements of the second tape to engage one another and (ii) the elements of the first tape and the elements of the second tape to disengage from one another.

11. The slider element of claim 10, wherein the female body portion comprises a recess, an upper ear adjacent an upper side of the recess, and a lower ear adjacent a lower side of the recess.

12. The slider element of claim 11, wherein, when the male removable portion and the female body portion are coupled with one another:

at least a portion of the male removable portion is disposed within the cavity of the female body portion;

at least a portion of the male removable portion is disposed within the recess of the female body portion;

a first end surface of the upper engaging member contacts a first inner face of the upper ear of the female body portion; and a second end surface of the lower engaging member contacts a second inner face of the lower ear of the female body portion.

13. The slider element of claim 11, wherein:

the female body portion comprises at least one rail disposed in the cavity;

the male removable portion comprises at least one channel; and the at least one rail is slidable within the at least one channel when the male removable portion is inserted into the cavity.

14. The slider element of claim 10, wherein insertion of the male removable portion into the cavity of the female body portion comprises movement that is approximately perpendicular to a longitudinal direction of the first tape and the second tape.

* * * * *